United States Patent [19]

Oglesbee

[11] Patent Number: 5,060,814

[45] Date of Patent: Oct. 29, 1991

[54] MOLDED PLASTIC CONTAINER FOR PACKAGING MULTIPLE PRODUCT SAMPLES

[75] Inventor: Richard K. Oglesbee, Lancaster, Ohio

[73] Assignee: Abbott Laboratories, Abbott Park, Ill.

[21] Appl. No.: 600,957

[22] Filed: Oct. 22, 1990

[51] Int. Cl.[5] ..... B65D 51/04

[52] U.S. Cl. ..... 220/339; 206/45.34; 206/470; 206/471

[58] Field of Search ..... 206/461, 463, 470, 471, 206/446, 45.34, 45.33; 220/339, 337; 229/2.5 R

[56] References Cited

U.S. PATENT DOCUMENTS

| | | | |
|---|---|---|---|
| 2,088,107 | 7/1937 | Hassenfeld | 220/337 |
| 2,446,264 | 8/1948 | Cox | 229/2.5 EC |
| 2,925,191 | 2/1960 | Shiffman | 220/339 |
| 3,933,296 | 1/1976 | Ruskin et al. | 229/2.5 R |
| 4,090,658 | 5/1978 | Fukuda | 229/2.5 EC |
| 4,378,068 | 3/1983 | Bell | 206/461 |
| 4,666,037 | 5/1987 | Weissman | 206/470 X |
| 4,732,273 | 3/1988 | DeMarco | 206/470 |
| 4,884,718 | 12/1989 | Leahy | 220/339 |
| 4,915,251 | 4/1990 | Payne | 220/306 |
| 4,986,438 | 1/1991 | Borst | 229/2.5 R X |

FOREIGN PATENT DOCUMENTS

| | | | |
|---|---|---|---|
| 2123469 | 11/1972 | Fed. Rep. of Germany | 220/339 |

*Primary Examiner*—Bryon P. Gehman

*Attorney, Agent, or Firm*—Lonnie R. Drayer; DOnald O. Nickey; E. H. Gorman, Jr.

[57] ABSTRACT

A unitary container for packaging multiple product samples has a front panel and two rear panels which are hingedly attached to the front panel. The two panels may be mechanically retained in a preferred relationship with respect to the front panel and one another by protrusions in one panel that extend through apertures in another panel. The panels are configured such that the container has several compartments for holding product samples.

13 Claims, 9 Drawing Sheets

38
42
46
78
10
46
42
36
14
45
14
53
12
24
55
61
54
12
62
32
16
40

58
68
59
74
68
80
68
74
72
65
81
46
45
65
30
32
72
72
32
74
74
32
70
70
34
61

MOLDED PLASTIC CONTAINER FOR PACKAGING MULTIPLE PRODUCT SAMPLES

TECHNICAL FIELD

The present invention relates generally to a molded plastic container, and more particularly, to such an article used for packaging a promotional package for pediatric nutritional product having a plurality of panels separated by hinged means.

BACKGROUND OF THE INVENTION

Before a newborn infant leaves the hospital, the mother is customarily given a complimentary sample of a pediatric nutritional product. Often this food product is accompanied by additional gifts, all of which are initially packaged in a single container. Typically this container is thermoformed from a transparent plastic material. Such a container typically is of the type known as a "clamshell", having two molded panels separated by a single hinge means with cooperatively fitting locking lugs provided at the end of both panels opposite the hinge edge. However, it is understood that a container according to the invention may be used for packaging samples of products other than pediatric nutrition products.

Promotional packages are subject to shock load and vibration during transport and handling. Shock load occurs where the package is accidentally dropped, thereby imparting a sudden force upon the package. Vibration occurs during normal transporting and handling to a minor degree, but over time coupled with shock load can result in at least one, if not more, of the locking lugs disengaging and thus the package falling open. The problem is not serious if the product weighs only a few ounces. However, when the sample increases in size and weight to approximately two pounds, the securing force exerted by the locking lugs of the plastic container can more easily be overcome by the combination of shock load and vibration, and by forces exerted directly on the locking lugs. Thus, when used with large samples, a container may unexpectedly open, thereupon spilling and/or breaking its contents. Even if the container only partially opens, the incident can be annoying and distracting to the parents of newborns.

It is also known that containers capable of accommodating greater weight have been made having a front panel, a single rear panel and a bottom panel. The relatively triangular or beveled-looking container utilizes locking lugs to retain the front panel to the rear panel. However, this multi-panel embodiment still suffers from drawbacks related to shock load. Attempts at overcoming this problem result in locking lugs which are often difficult to unfasten, or require a package with a relatively large number of locking lugs, for example five or more.

It is thus apparent that the need exists for an improved package for a container which provides structural integrity yet allows for the easy opening of the container.

SUMMARY OF THE INVENTION

The problems associated with prior containers are overcome in accordance with the present invention by providing a container comprising a front panel, a first rear panel; a second rear panel; means for hingedly connecting the front panel to the first rear panel; means for hingedly connecting the front panel to the second rear panel; and means for mechanically retaining the first and second rear panels to the front panel.

The front panel has a top edge and a bottom edge, with the first rear panel hinge means being along the top edge and with the second rear panel hinge means being along the bottom edge. The container is formed with a plurality of compartments therein, and at least a portion of the front panel and the rear panels are juxtaposed relative to each other, such that the first rear panel overlaps the second rear panel.

The retaining means comprise a first locking portion and a second locking portion, with the front panel including the first locking portion and the first rear panel including the second locking portion. The second rear panel preferably includes an aperture through which the second locking portion projects for mechanical interconnection with the first locking portion.

The container also comprises means for aligning the front panel relative to the rear panels. Furthermore, there are means for aligning the first rear panel relative to the second rear panel. The front and rear panels have two side edges with the means for aligning the front panel relative to the rear panels being adjacent these side edges, as well as the means for mechanically retaining the first and second rear panels to the front panel being formed adjacent these side edges.

There is also disclosed herein a container for a promotional package of a pediatric nutritional product comprising a front panel having top and bottom edges, a first rear panel, a second rear panel with the front panel and rear panels having two side edges, means for hingedly connecting the front panel to the first rear panel, the rear panel hinge means being along the top edge, means for hingedly connecting the front panel to the second rear panel, with the second rear panel hinge means being along the bottom edge, means for mechanically retaining the first and second rear panels to the front panel, means for mechanically retaining the first and second rear panels to the front panel being adjacent the side edges, means for aligning the front panel relative to the rear panels with such means being adjacent the side edges, means for aligning the first rear panel relative to the second rear panel, and means for mechanically retaining only the first rear panel to the front panel, the container having a plurality of compartments formed therein with at least one compartment extending from the top edge to the bottom edge.

There is further disclosed a unitary plastic container having a front panel having top and bottom edges, a first rear panel, means for hingedly connecting the front panel to the first rear panel, means for mechanically attaching the front panel to the first rear panel, and means for aligning the front panel relative to the first rear panel, the improvement comprising a second rear panel, means for hingedly connecting the front panel to the second rear panel, with the first rear panel hinge means being along the top edge and the second rear panel hinge means being along the bottom edge, with means for attaching the front panel to the first rear panel also retaining the second rear panel relative to the front panel and the first rear panel, and means for aligning the first rear panel relative to the second rear panel.

The container also includes the improvement comprising the front panel and rear panels having side edges with means for aligning the front panel relative to the first rear panel being adjacent the side edges. Additionally, the means for retaining the front panel to the first rear panel is adjacent the side edges, and the first rear panel overlaps the second rear panel. Furthermore, the improvement comprises retaining means including a first locking portion and second locking portion, with the front panel including the first locking portion and the first rear panel including the second locking portion. The second rear panel includes an aperture through which the second locking portion projects for mechanical interconnection with the first locking portion. Further, the improvement comprises one compartment extending from the top edge to the bottom edge with this one compartment having a top surface and a bottom surface with the top surface having a plurality of ribs formed therein.

It is a primary objective of the present invention to provide a container for a promotional package of samples of a pediatric nutritional product which provides structural integrity for use with larger samples.

Still another objective of the present invention is to provide a unitary container which can be conveniently and easily formed, and quickly and easily assembled to create an aesthetically appealing container.

Other objects and advantages of the invention will be apparent from the following description, the accompanying drawings, and the appended claims.

DETAILED DESCRIPTION OF THE INVENTION

Figure 1:
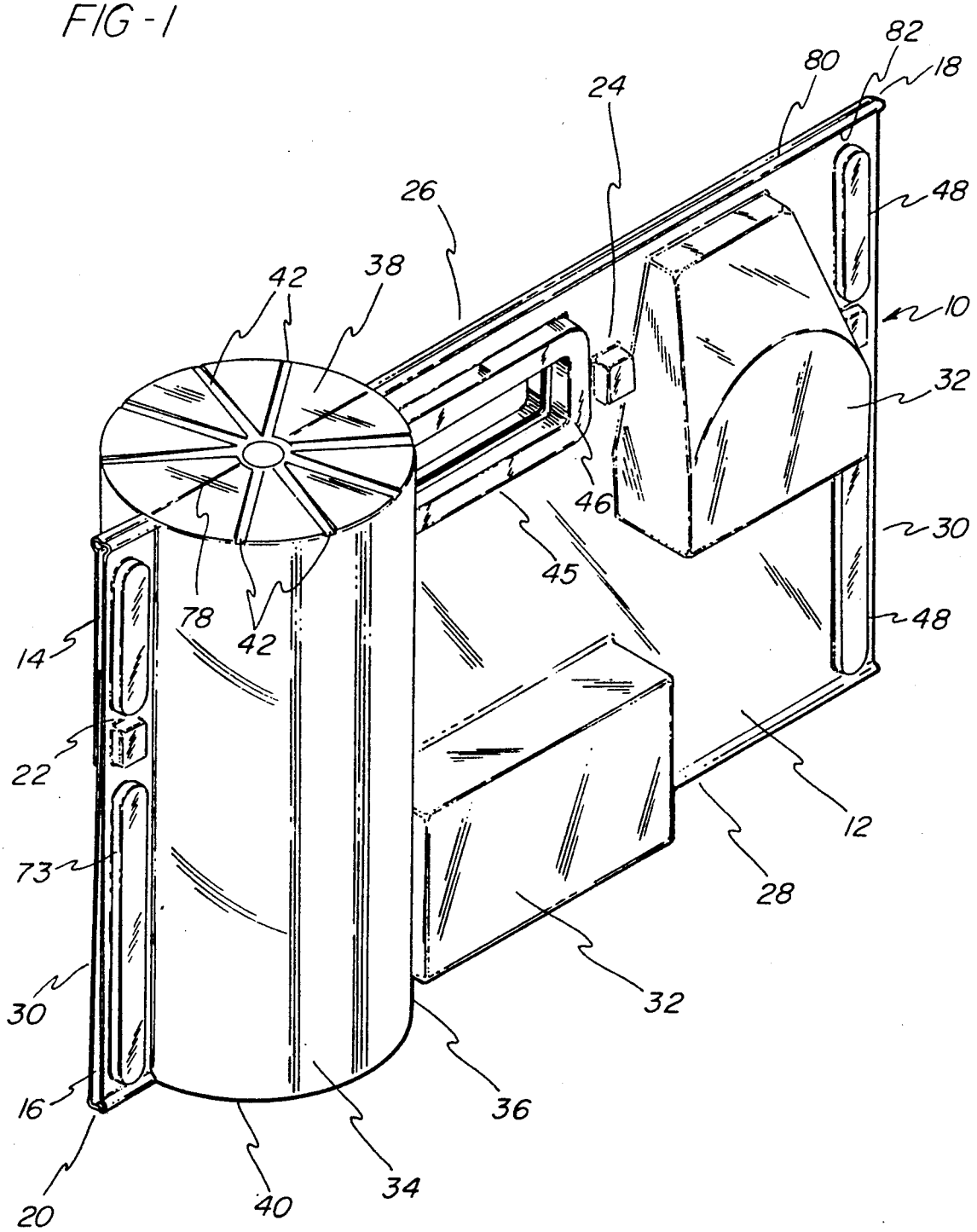
FIG. 1 is a first perspective view of a container in accordance with the present invention.
Figure 2:
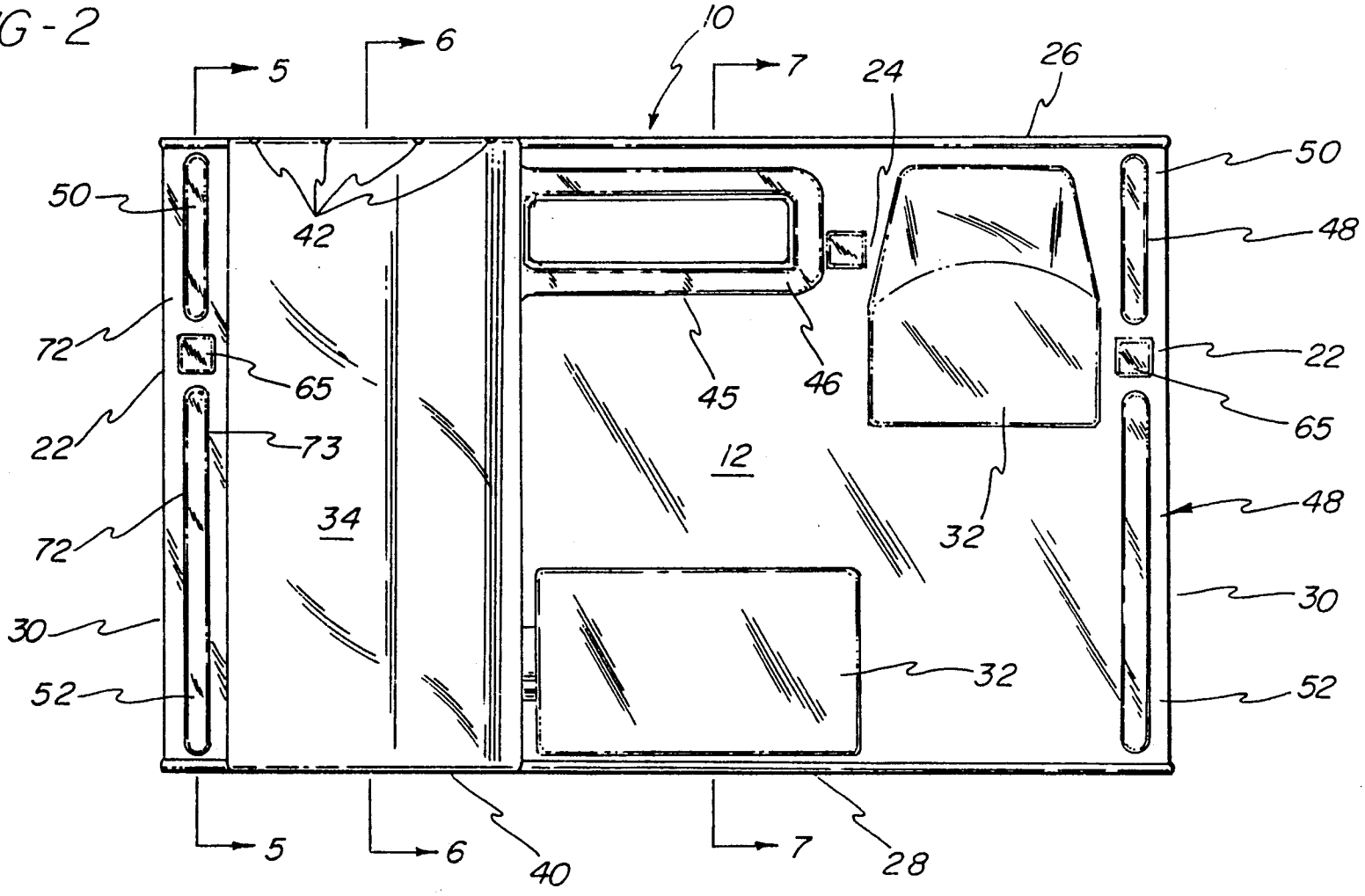
FIG. 2 is a first elevational view of the container shown in FIG. 1.

Having reference to the drawings, attention is directed first to FIG. 1 which is a perspective view of a container embodying this invention designated generally by the numeral 10. As can be seen in FIGS. 1–4, the container 10 comprises a front panel 12 which is hingedly connected to a first rear panel 14 and a second rear panel 16. Front panel 12 is connected to rear panel 14 along first hinge means 18. The front panel 12 is also hingedly connected to the second rear panel 16 along second hinge means 20. At least a portion of the front panel 12 and the rear panels 14 and 16 are superposed relative to one another when the container is fully assembled. Put another way, a container according to the preferred embodiment of the invention comprises a single sheet of a suitable material formed into a front panel 12 and two rear panels 14, 16 with the front panel connected to each of the rear panels by hinge means 18, 20.

Preferably the container comprises transparent plastic materials which may be thermoformed so as to provide a unitary structure. For example, in the preferred embodiment of the invention, polyethylenetriglycol (PETG) that is 0.02" (0.508 mm) thick prior to thermoforming is used.

A first retention means 22 located near the edges of the package 10 serves to secure the front panel to the rear panels. A second retention means 24 located part way between the first retention means 22 and more towards the center of the container 10 serves as an additional means to secure the front panel 12 to the first rear panel 14.

The container 10 has a front panel top 26, a front panel bottom 28, and a pair of side edges 30, 30. As can be seen, the container 10 is formed so as to include a plurality of compartments 32, with one compartment 34 having a cylindrical shape when the container is completely assembled, a top surface 38, and a bottom surface 40. The side wall 36 of the cylindrical compartment 34 can be appreciated then as also extending in the preferred embodiment of the invention from the front panel top 26 to the front panel bottom 28. The top surface as can be seen in FIGS. 1, 3, 4 and 5 has a plurality of ribs 42 formed therein.

Figure 3:
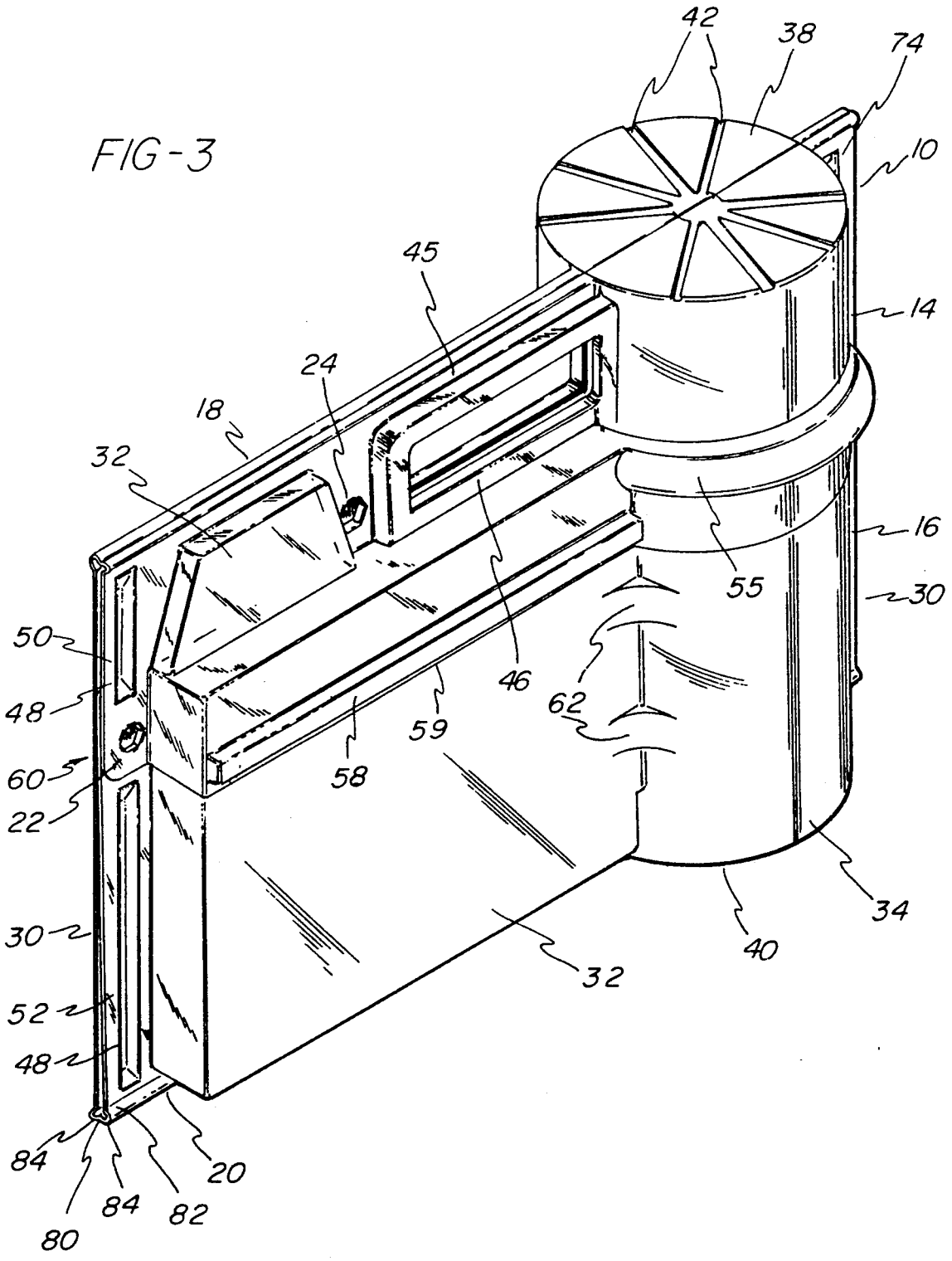
FIG. 3 is a second perspective view of the rear of the container shown in FIG. 1 looking from the opposite direction from FIG. 1.
Figure 4:
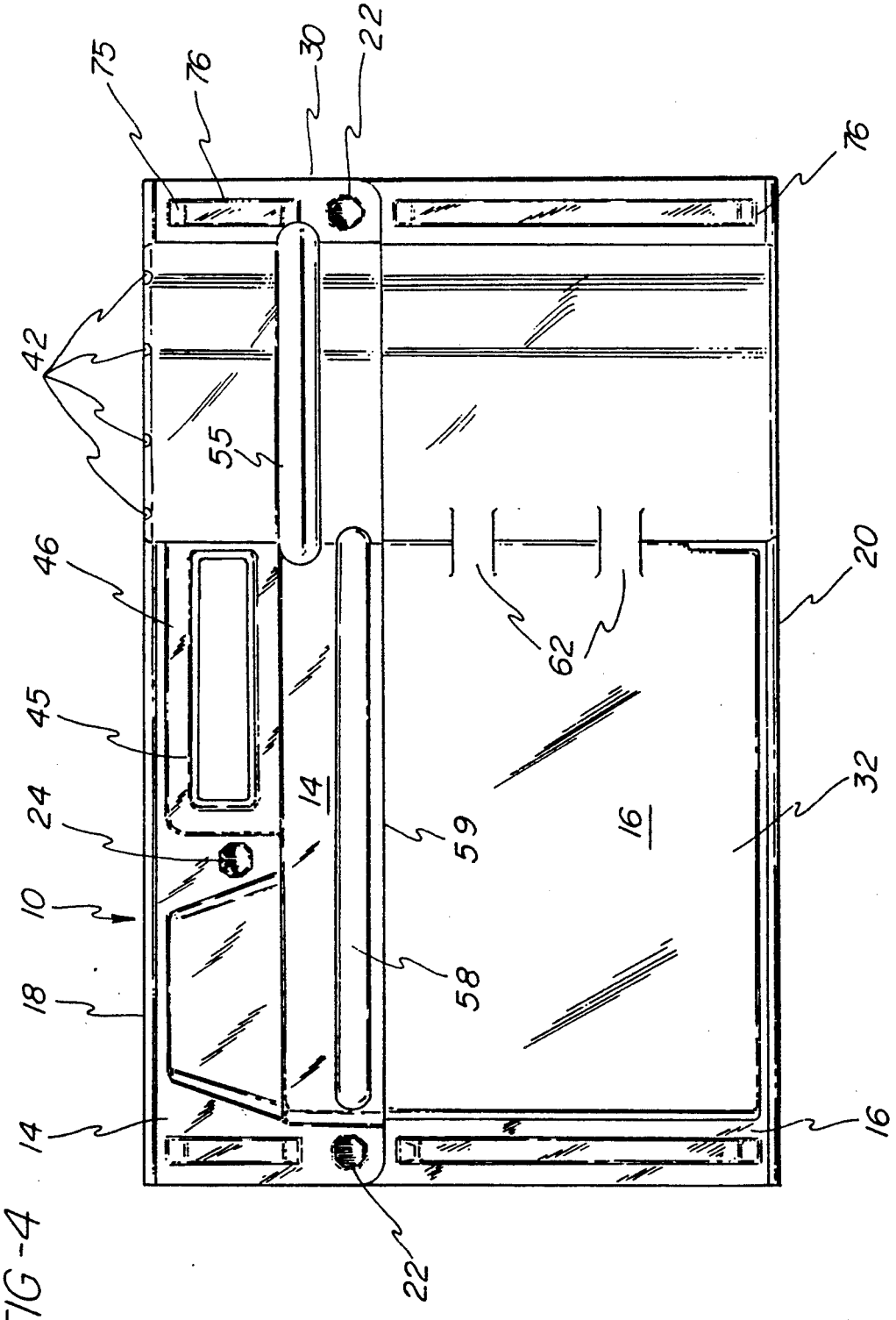
FIG. 4 is a second elevational view of the container shown in FIG. 1 looking from the opposite direction from FIG. 2.
Figure 5:
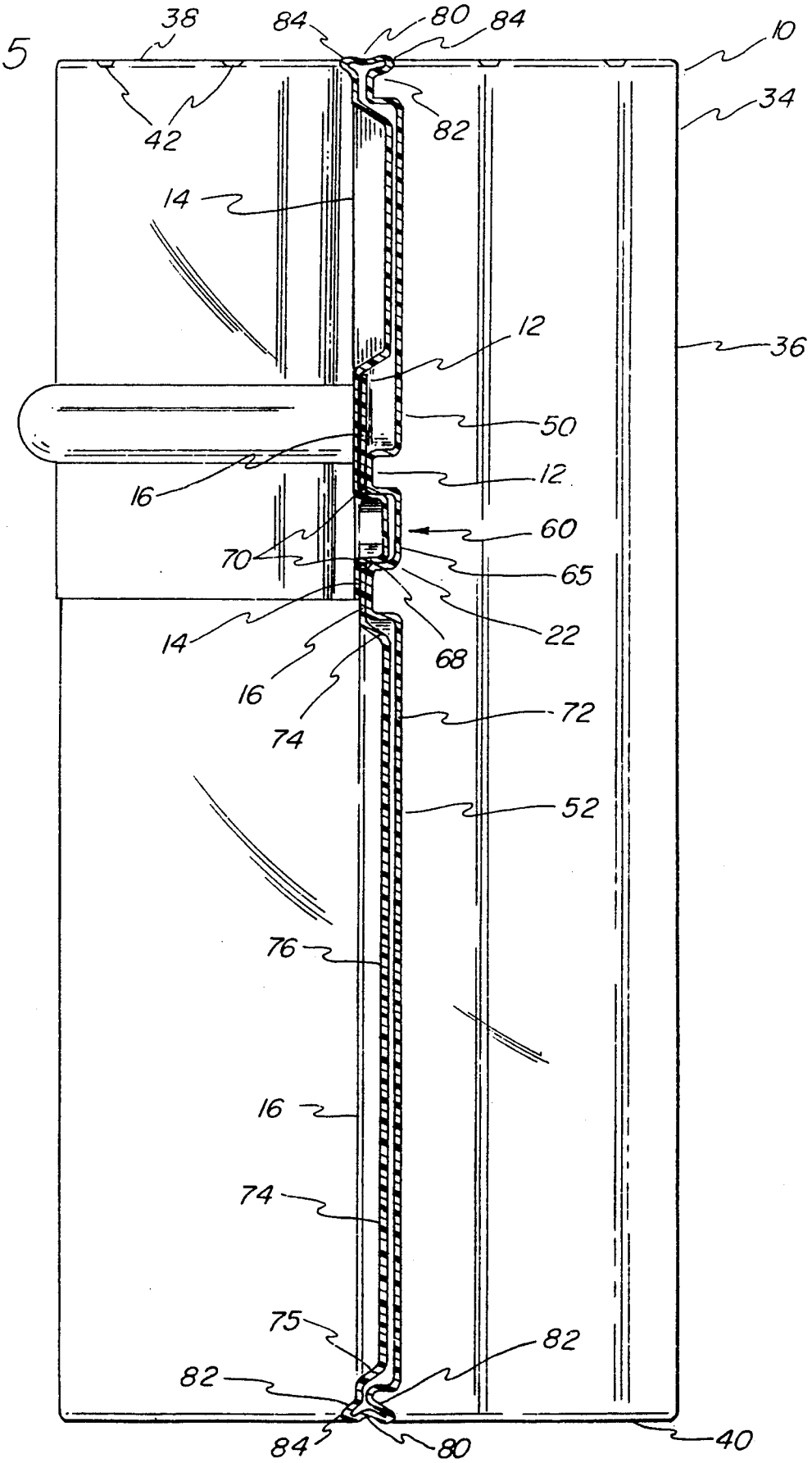
FIG. 5 is a first cross-sectional view of the container taken along line 5—5 of FIG. 2.
Figure 6:
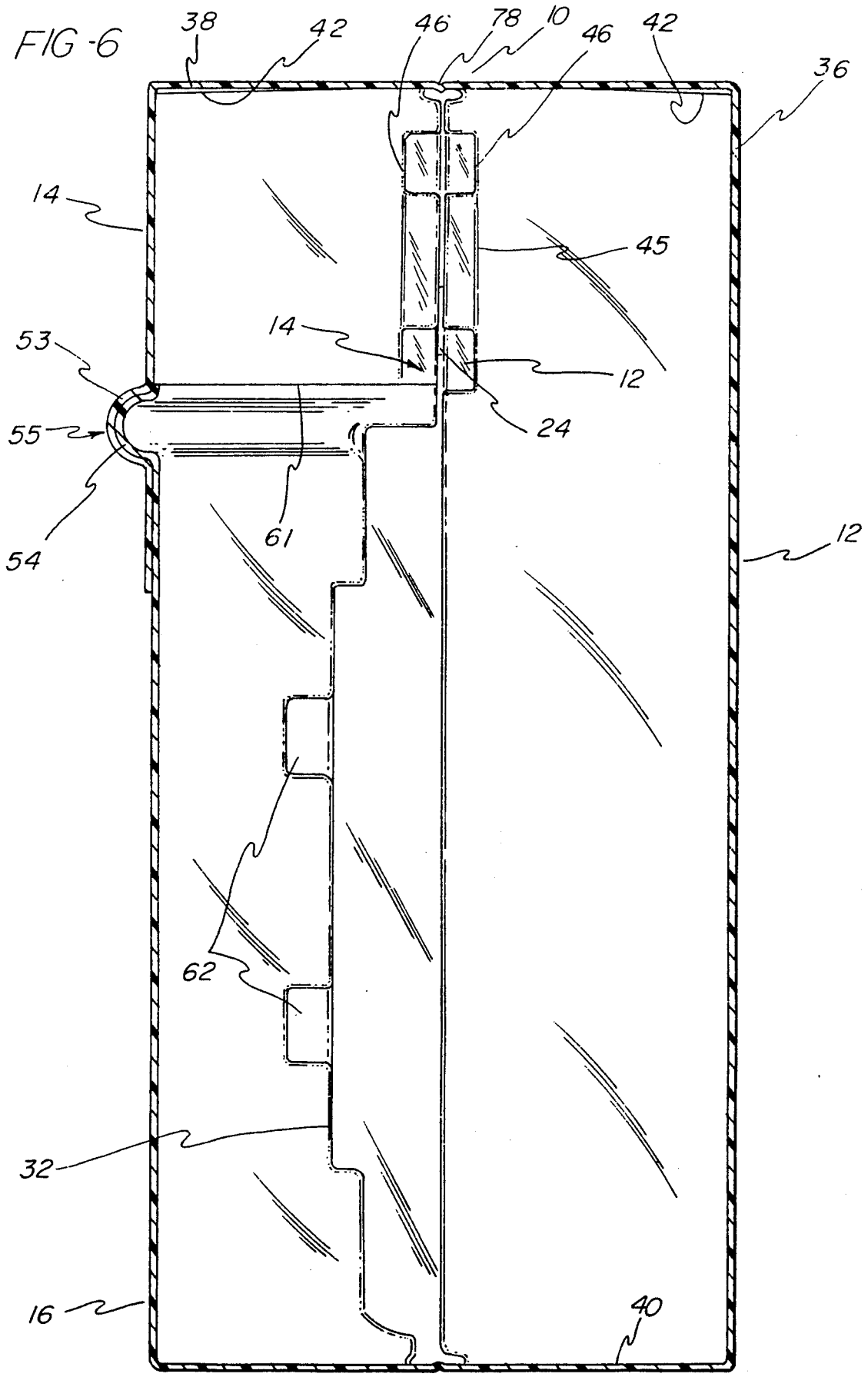
FIG. 6 is a second cross-sectional view of the container taken along line 6—6 of FIG. 2.
Figure 7:
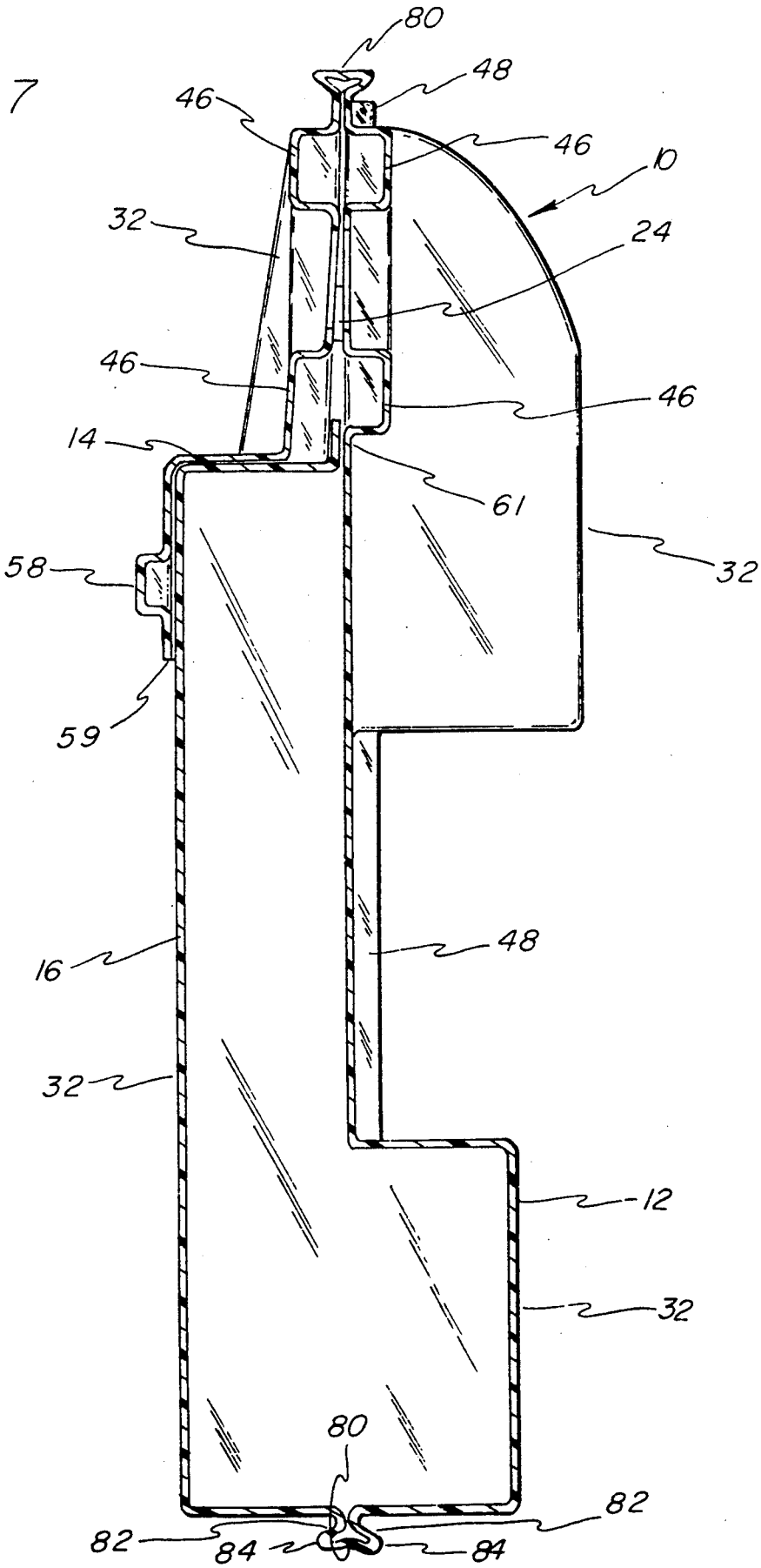
FIG. 7 is a third cross-sectional view of the container taken along line 7—7 of FIG. 2.

The container 10 also is formed with a handle 45 having, as can be seen in FIGS. 1, 3, and 7, a raised handle portion 46. In addition to first retention means 22,22 being located adjacent the side edges 30,30 a raised edge alignment means 48 extends vertically along the opposing edges 30 of the container 10. The edge alignment means 48, as can best be seen in FIGS. 1, 3, and 5, comprises a first edge alignment means 50 and a second edge alignment means 52. As can be seen in FIG. 5, the first edge alignment means and second edge alignment means mechanically interengage with one another to not only assist in aligning, but also to assist in retaining the front and rear panels in the desired spatial relationship to one another. As can best be seen in FIG. 6, an outer band 53, which is part of the first rear panel 14, and an inner band 54, which is part of the second rear panel 16, cooperate to form a rear panel alignment means 55 which is located on the rear side of the cylindrical compartment 34.

Additional support for the rear panels is provided by a first rear panel rib 58, which extends horizontally along the first rear panel 14 just above the first rear panel bottom edge 59. This first rear panel rib 58 is located in the region of overlap 60 shown in FIGS. 3 and 5 with respect to the first and second rear panels 14 and 16, respectively. Associated with this region of overlap 60 and second rear panel 16 is a second rear panel top edge 61 as can be seen in FIG. 7.

Additionally, second rear panel ribs 62 are provided along the second rear panel 16, as can be seen in FIG. 3, to provide for further structural rigidity for the side wall 36 of the cylindrical compartment 34. As best shown in FIGS. 2, 4, 5, and 9, the first and second retention means 22 and 24, respectively are formed having a first locking portion 65 and a second locking portion 68. The first locking portion 65 is in the configuration of a square, while the second locking portion 68 is in the configuration of an octagon. Although other geometric configurations could be used, the result is that frictional engagement is possible, but such engagement can be undone without excessive expenditure of energy. This engagement mechanically retains the front panel to the rear panels.

Figure 8:
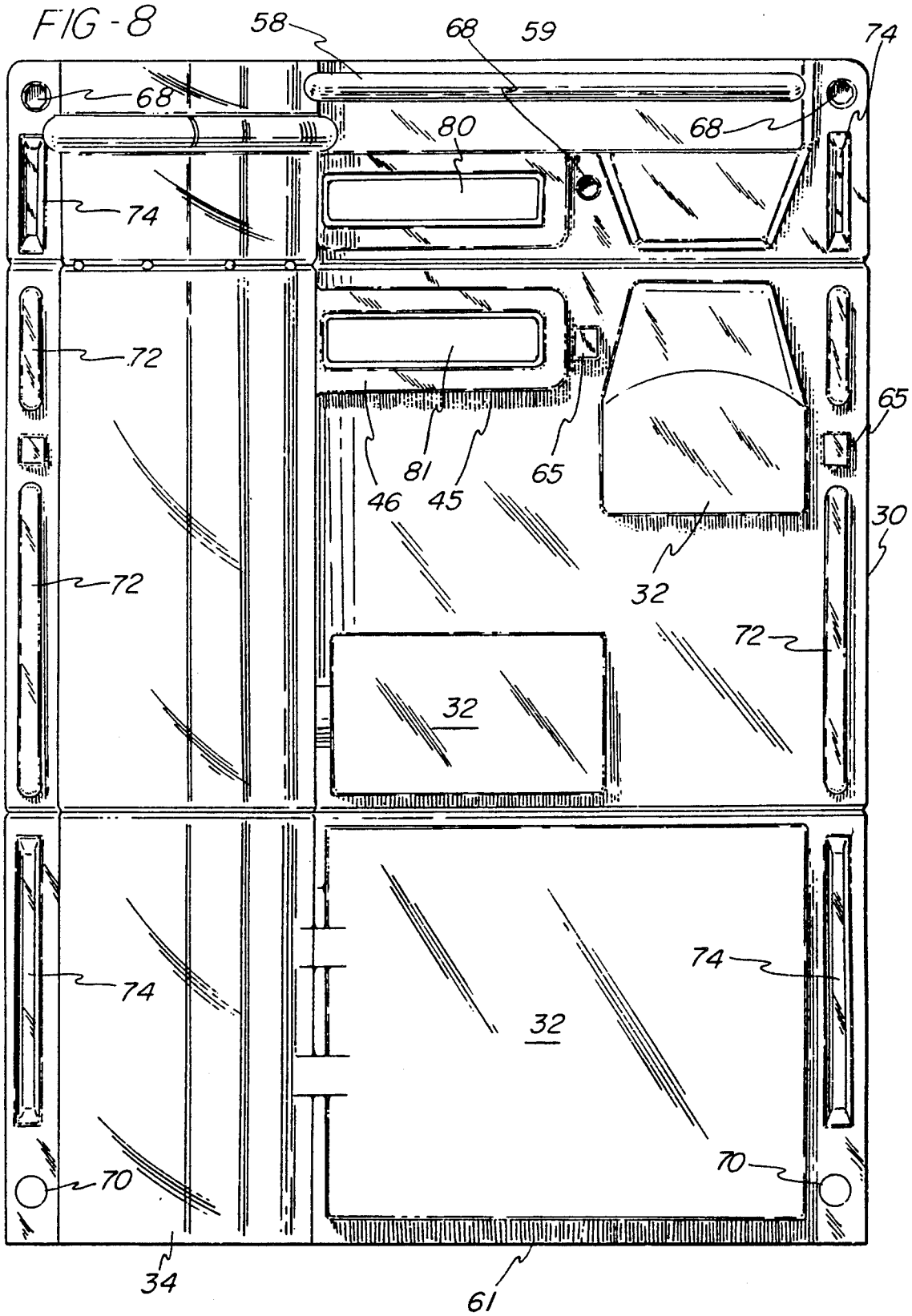
FIG. 8 is an elevational view of the invention prior to its being folded into the operative embodiment of the invention.
Figure 9:
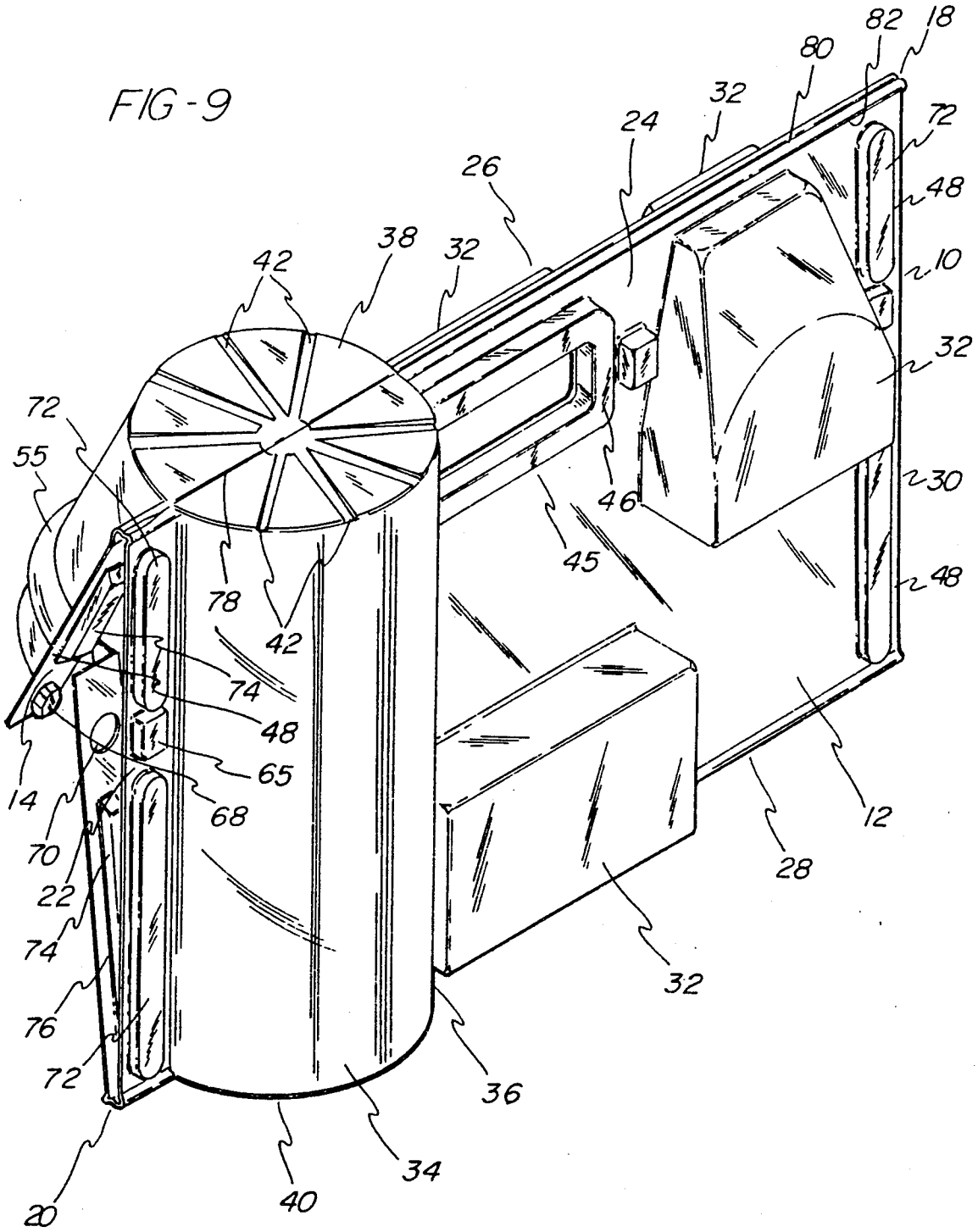
FIG. 9 is a perspective view similar to FIG. 1, but showing the container slightly opened.

As can be seen in FIGS. 5, 8 and 9, in the region of overlap 60, the second locking portion 68 extends through an aperture 70 in the second rear panel 16 and projects into the first locking portion 65. A similar mechanical relationship to the locking portions exists with respect to the edge alignment means 48. Each first edge alignment means 50 and second edge alignment means 52 are formed such that each front panel has a front panel edge alignment means 72 having a curved side wall 73. Each rear panel 14 and 16 has a rear panel edge alignment means 74 with a beveled top and bottom portion 75 and a panel edge alignment means 74 with a beveled top and bottom portion 75 and a rectilinear peripheral wall 76. The rear panel edge alignment means 74 mechanically engage with the front panel edge alignment means similar to the manner discussed above with respect to the first and second edge alignment means.

Associated with both the first and second hinge means 18 and 22, respectively, is a single fold line 78 which extends across the top surface 38 of compartment 34, and a central fold line 80 which extends substantially along the remainder of each of the hinge means 18 and 22. This central fold line 80 works in conjunction with a secondary fold line 82 separated from the central fold line by curved portions 84.

A container according to the present invention is fabricated through thermoforming of a plastic material to produce a plastic sheet as shown in FIG. 8. This plastic sheet then is die cut so as to form the apertures 70 in the second rear panel and openings 80, 81 in both cooperative parts of handle 45, and to trim along side edge 30, first rear panel bottom edge 59 and second rear panel top edge 61.

In actual operation, samples of a pediatric nutritional product or other objects may be placed into the unitary plastic container of this invention. The first and second rear panels are folded along first and second hinge means as shown in FIG. 9, such that second rear panel 16 is ultimately overlapped by the first rear panel bottom edge 59 as shown in FIG. 3. The first and second edge alignment means 50 and 52 respectively are mechanically engaged. The first and second retention means 22 and 24 respectively may then be snapped into place. This snapping force is applied perpendicularly to the container panels, such that any shock load and vibrational forces are not solely directed to the retaining means but are for the most part dissipated at the hinges.

To open the container, all that is necessary is to grasp the first rear panel adjacent the first retention means and pull so as to disengage the first locking portion 65 from the second locking portion 68. Once the first and second retention means are disengaged, the first and second rear panels may hingedly be swiveled away from engagement with the front panel 12 so as to expose the objects contained therein.

While the form of article herein described constitutes a preferred embodiment of this invention, it is to be understood that the invention is not limited to this precise form of article, and that changes may be made therein without departing from the scope of the invention which is defined in the appended claims.

What is claimed is:

1. A container comprising: a front panel having a top edge and a bottom edge;

a first rear panel;

a second rear panel;

means disposed along the top edge of said front panel for hingedly connecting said front panel to said first rear panel;

means disposed along the bottom edge of said front panel for hingedly connecting said front panel to said second rear panel; and retaining means for mechanically retaining said first and second rear panels adjacent to said front panel with said first and second rear panels in an overlapping relationship, said retaining means comprising (a) said front panel including a first locking portion, (b) one of said rear panels including a second locking portion, and (c) the rear panel which does not include the second locking portion having an aperture therethrough through which one of said locking portions projects for mechanical interconnection with the other locking portion.

2. A container according to claim 1 wherein said container is formed with a plurality of compartments therein.

3. A container according to claim 2 which includes means for aligning said front panel relative to said rear panels.

4. A container according to claim 3 which includes means for aligning said first rear panel relative to said second rear panel.

5. A container according to claim 3 wherein said front panel and said rear panels each have two side edges, said means for aligning said front panel relative to said rear panels being adjacent said side edes.

6. A container according to claim 2 wherein one of said compartments extends from said top edge to said bottom edge.

7. A container according to claim 6 wherein said one of said compartments has a top surface and a bottom surface, said top surface having a plurality of ribs formed therein.

8. A container according to claim 1 wherein said front panel and said rear panels each have two side edes, said means for mechanically retaining said first and second rear panels to said front panel being formed adjacent said side edges.

9. A container comprising:

a front panel having a top edge and a bottom edge;

a first rear panel;

a second rear panel, said front panel and said rear panels each having two side edges;

means disposed along the top edge of said front panel for hingedly connecting said front panel to said first rear panel;

means disposed along the bottom edge of said front panel for hingedly connecting said front panel to said second rear panel;

retaining means for mechanically retaining said first and second rear panels adjacent to said front panel with said first and second rear panels in an overlapping relationship, said retaining means comprising (a) said front panel including a first locking portion, (b) one of said rear panels including a second locking portion, and (c) the rear panel which does not include the second locking portion having an aperture therethrough through which one of said locking portions projects for mechanical interconnection with the other locking portion, said retaining means for mechanically retaining said rear panels adjacent to said front panel being adjacent said side edges;

means for aligning said front panel relative to said rear panels, said means for aligning said front panel relative to said rear panels being adjacent said side edges;

means for aligning said first rear panel relative to said second rear panel; and said container having a plurality of compartments formed therein with at least one compartment extending from said top edge to said bottom edge.

10. A unitary plastic container comprising a front panel having a top edge and a bottom edge, a first rear panel hingedly connected to said front panel retaining means for mechanically retaining said front panel adjacent to said first rear panel, and means for aligning said front panel relative to said first rear panel, a second rear panel hingedly connected to said front panel, said first rear panel being hingedly connected along said top edge and said second rear panel being hingedly connected along said bottom edge, wherein the improvement comprises said first and second rear panels being in an overlapping relationship and said retaining means for retaining said front panel to said first rear panel also retaining said second rear panel relative to said front panel and said first rear panel, said retaining means including a first locking portion and a second locking portion, said front panel including said first locking portion and said first rear panel including said second locking portion, said second rear panel including an aperture through which said second locking portion projects for mechanical interconnection with said first locking portion, and means for aligning said first rear panel relative to said second rear panel.

11. A container according to claim 10 wherein the improvement further comprises said front panel and said rear panels having side edges, said means for aligning said front panel relative to said first rear panel being adjacent said side edges.

12. A container according to claim 11 wherein the improvement further comprises said means for retaining said front panel to said first rear panel being adjacent said side edges.

13. A container according to claim 10 wherein the improvement further comprises one compartment extending from said top edge to said bottom edge, said one compartment having a top surface and a bottom surface, said top surface having a plurality of ribs formed therein.

* * * * *